US006729571B2

(12) United States Patent
Morhard

(10) Patent No.: US 6,729,571 B2
(45) Date of Patent: May 4, 2004

(54) WINDING SHAFT FOR WINDING STRIP-TYPE MATERIALS

(75) Inventor: Alfred Morhard, Altensteig-Walddorf (DE)

(73) Assignee: WT Wickeltechnik GmbH, Wiehl (DE)

( * ) Notice: Subject to any disclaimer, the term of this patent is extended or adjusted under 35 U.S.C. 154(b) by 7 days.

(21) Appl. No.: 10/258,305

(22) PCT Filed: Feb. 2, 2002

(86) PCT No.: PCT/EP02/01082

§ 371 (c)(1),
(2), (4) Date: Oct. 23, 2002

(87) PCT Pub. No.: WO02/068304

PCT Pub. Date: Sep. 6, 2002

(65) Prior Publication Data

US 2003/0102400 A1 Jun. 5, 2003

(30) Foreign Application Priority Data

Feb. 24, 2001 (DE) ..... 101 09 104

(51) Int. Cl.[7] ..... B65H 18/08

(52) U.S. Cl. ..... 242/530.3

(58) Field of Search ..... 242/530.3, 545.1

(56) References Cited

FOREIGN PATENT DOCUMENTS

| | | |
|---|---|---|
| DE | 195 15 723 A1 | 11/1996 |
| EP | 0155460 | 9/1985 |
| EP | 0863101 | 9/1998 |

*Primary Examiner*—John Q. Nguyen
(74) *Attorney, Agent, or Firm*—Friedrich Kueffner

(57) ABSTRACT

The recoiler (1) for recoiling strip-shaped materials for slitting and recoiling machines for the slitting of thin metal strip into individual strips (2) and the recoiling of the individual strips (2) into coils (3) is equipped with a hydraulic device for transmitting a constant torque from the core shaft (4) to the coiling sleeves (16) of the individual coils (3) during the recoiling of the individual strips (2) at a constant strip tension (B).

7 Claims, 2 Drawing Sheets

WINDING SHAFT FOR WINDING STRIP-TYPE MATERIALS

The invention concerns a recoiler for recoiling strip-shaped materials, especially for slitting and recoiling machines for the longitudinal slitting of chiefly thin rolled strip made of metal and steel into individual strips and the recoiling of the individual strips into strip coils, with a core shaft that can be driven by a motor, clamping devices for securing the strip-coil coiling sleeves, which can be slid onto and pulled off of the recoiler, and structural components for transmitting the torque of the core shaft to the individual coiling sleeves during recoiling of the individual strips with equal or approximately equal strip tension.

The recoiling of the individual strips produced by longitudinal slitting of a rolled strip onto coiling sleeves, which are arranged on a common recoiler, involves problems arising from the nature of rolled strip. Rolled strip has different thicknesses in the center and at the edges. The center thickness is usually somewhat greater than the thickness at the two edges. Therefore, internal mechanical stresses are present in the strip between the edges and the center of the strip. When the rolled strip is slit into individual strips by a slitting machine, the internal stresses are relieved. This results in different lengths of the individual strips, i.e., the individual strips derived from the thicker central region of the rolled strip are shorter, and the individual strips derived from the thinner marginal regions of the rolled strip are longer. The different lengths and different strip thicknesses must be compensated to coil all of the individual strips with the same strip tension, if the individual strips are to be recoiled on coiling sleeves that are arranged on a common recoiler, and if all of the individual strips are to be recoiled equally tightly.

To recoil several coils of strip-shaped materials on a recoiler of the generic type described in EP 0 863 101 A1, a core shaft equipped with frictional elements is used to kinematically uncouple the individual strip coils and to apply well-defined torques. The goal of this is to load all of the strip coils, regardless of their particular strip widths, with specifically equal strip tension to avoid wrinkling and deformation within the slitting machine and destruction of individual strips of material.

The previously known recoiler for recoiling strip-shaped materials on coiling sleeves consists of a core shaft annularly surrounded by frictional elements and radially acting clamping devices, which, in the operating position, produce frictional engagement between friction elements driven by the core shaft and the frictional elements, by which a torque can be transmitted from the core shaft to the frictional elements, accompanied by slip. The frictional elements can move towards the outside to produce a torsionally rigid connection between the frictional elements and the coiling sleeve during operation.

The clamping devices move the frictional elements radially outward via the friction elements by means of the radial forces they apply and bring the frictional elements against the coiling sleeve to reliably ensure slip-free driving of the coiling sleeve with a certain torque. In this regard, under the influence of the radial forces of the clamping devices that act in the operating position, the torque transmitted by the friction pairing friction element/frictional element is less than the torque that can be transmitted by the friction pairing frictional element/coiling sleeve, so that a torsionally rigid drive is produced between the frictional element and the coiling sleeve.

DE 195 15 723 A1 describes a generic recoiler, which consists of a core shaft with peripherally distributed longitudinal grooves, in each of which there is an outwardly directed antifriction strip and an inflatable pressure-medium hose for moving the antifriction strip radially outward. An annular backing material is placed on the core shaft, and the antifriction strips rest against the inner surface of the backing material. The antifriction strips, which extend the whole length of the core shaft, consist either of oil-impregnated strips of felt or of an antifriction material that can release lubricant. On the outer surface of the backing material, several obliquely running, peripherally distributed bearing surfaces interact with clamping devices in the form of balls. The balls are arranged in recesses of a clamping ring in such a way that, even in the untensioned state of the recoiler, they extend slightly beyond the outer surface of the clamping ring.

At the beginning of a recoiling operation, the coiling sleeves are slipped onto the friction recoiler. Since the balls extend slightly beyond the outside of the clamping ring, the coiling sleeves are very easily slid in the axial direction onto the friction recoiler until the desired or required position is reached. The individual pressure-medium hoses have been inflated in advance, so that frictional engagement with the backing material occurs through the antifriction strips, and the backing material turns clockwise together with the rotational movement of the core shaft. This causes the balls to be pushed farther to the outside due to the oblique position of the bearing surfaces, so that, finally, the coiling sleeves are held tightly in the position they have assumed. When the friction is released, the balls return to their original position, in which they extend slightly beyond the outer surface of the clamping ring, so that the completely coiled strip can then be easily pulled off of the recoiler.

With the previously known frictional recoilers, it is difficult, especially in the case of small strip coil diameters, to transmit a large torque from the core shaft to the coiling sleeves of the individual strip coils and to achieve uniform recoiling of the individual strips of material with a constant strip tension.

The goal of the invention is to develop a recoiler of the generic type, which allows uniform recoiling of strip coils with different diameters and coil widths.

In accordance with the invention, this goal is achieved by a recoiler for recoiling strip-shaped materials, which has the features specified in claim 1.

The subclaims contain effective and advantageous modifications of the invention.

The new recoiler represents an optimum solution of the problem on which the invention is based.

The invention will now be explained with reference to the schematic drawings.

Figure 1:
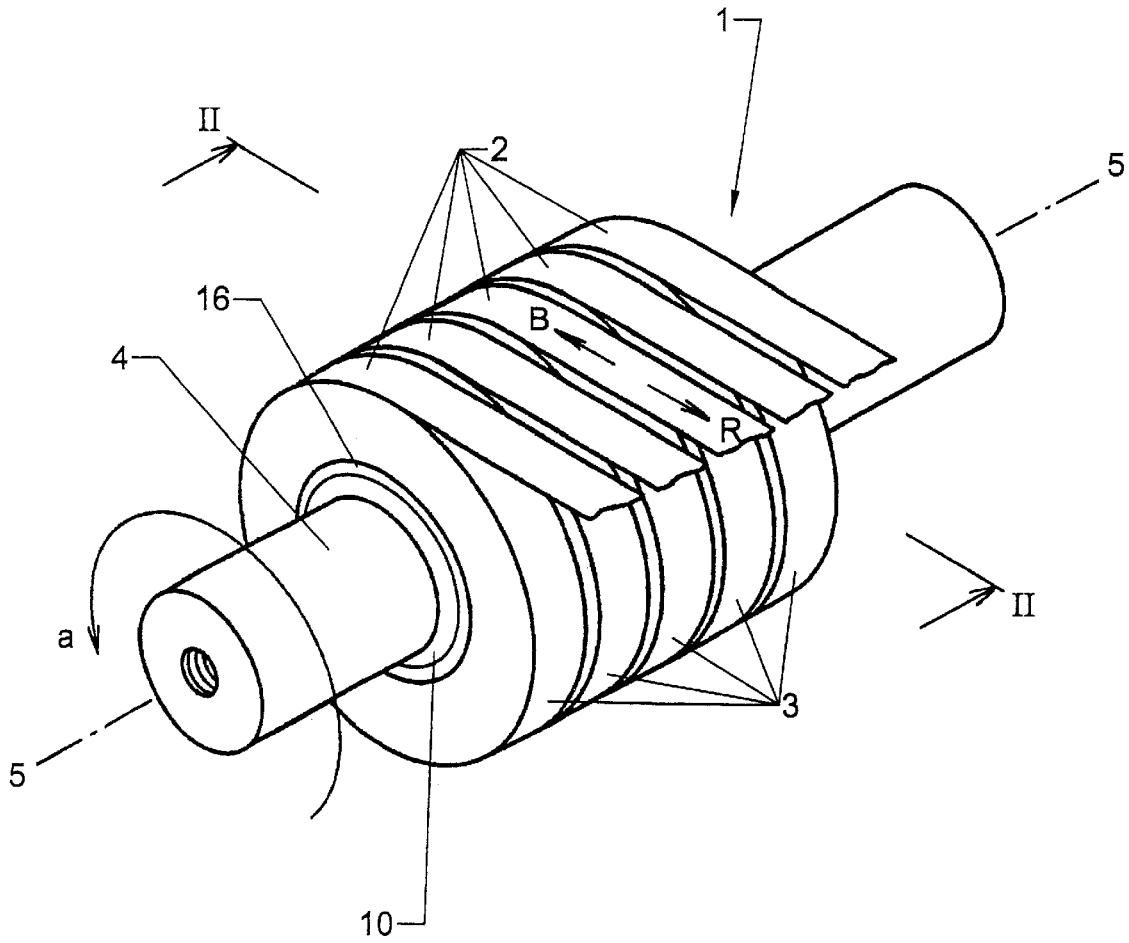
FIG. 1 shows a perspective view of a recoiler.
Figure 2:
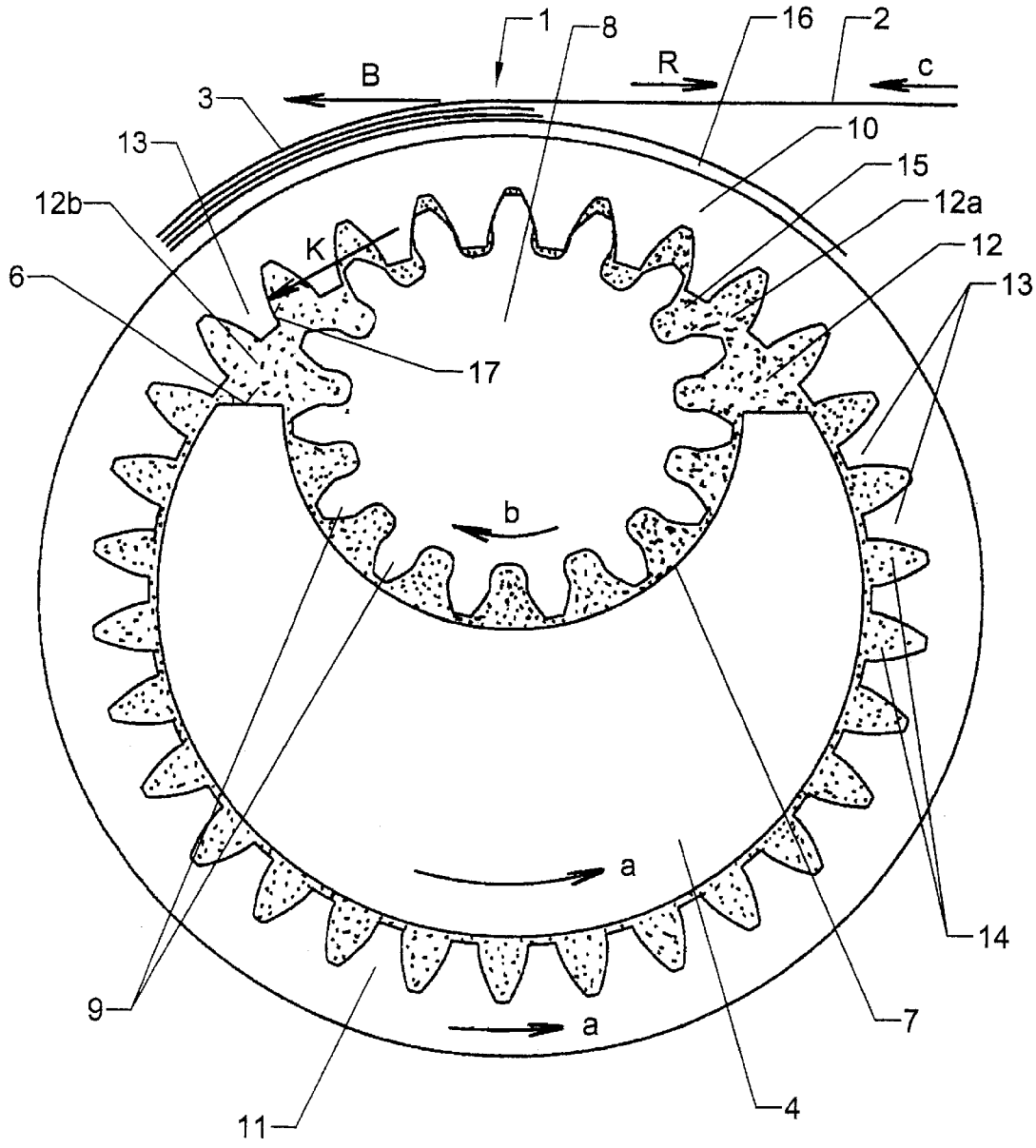
FIG. 2 shows a cross section of the recoiler along line II—II.

The recoiler 1 shown in FIGS. 1 and 2 is designed for recoiling individual strips 2 from a slitting and recoiling machine (not shown) for slitting thin rolled metal strip into individual strips and recoiling the individual strips into strip coils 3. The recoiler 1 has a motor-driven core shaft 4 with a truncation 6 that runs the length of the shaft in the direction of the shaft axis 5—5. A cylindrical groove 7, which runs the length of the core shaft 4, is formed as a bearing for a series of adjacent pinions 8 with external teeth 9. The anglular measure of the circular segment that constitutes the groove 7 of the core shaft 4 is a few degrees greater than 180°, and the angular measure of the circular segment that constitutes the outer circumference of the core shaft 4 is significantly greater than 180°.

Toothed rims 10 with internal teeth 11 are pivoted on the core shaft 4, and the internal teeth 11 engage the external teeth 9 of the pinions 8 that are assigned to the individual toothed rims 10.

The sets of pinions 8 and toothed rims 10, which are pivoted adjacent to each other in and on (respectively) the core shaft 4, are sealed liquid-tight from one another and from the two ends of the core shaft 4. In this way, the core shaft 4 forms a closed hydraulic chamber 12 with the toothed rims 10. The hydraulic chamber 12 is connected by channels (not shown) in the core shaft and by a feed line to an oil reservoir with an oil pump for filling with oil and for supplying cooling oil.

The pinions 8, which are arranged side by side, divide the hydraulic chanber 12 into two chambers 12*a*, 12*b*.

The two chambers 12*a*, 12*b* of the hydraulic chamber 12 and the tooth spaces 14 between the teeth 13 of the toothed rims 10 are filled with oil.

Clamping devices (not shown) are arranged on the outer circumference of the toothed rims 10 for clamping the coiling sleeves 16 for recoiling the individual strips 2. When individual strips 2 of equal width are being recoiled, the coiling sleeves 16 all have the same coil width, which is adapted to the width of the strip. To recoil individual strips 2 with different widths, corresponding coiling sleeves 16 with different coil widths are used. Depending on the width of the coil, the coiling sleeves 16 are clamped on one or more toothed rims 10 of the recoiler 1.

The recoiler operates in the following way:

At the beginning of a recoiling operation, in which several individual strips 2 are recoiled into coils 3 on coiling sleeves 16 clamped side by side on the core shaft 4 of a recoiler 1, a strip tension B, which acts on the individual strips 2 and is opposed by a back tension R in the opposite direction from the direction of travel c of the strip, is created by the core shaft 4, which is driven in the counterclockwise direction (a), when its speed is raised from a value of zero to the operating speed. The core shaft 4, which is driven in the direction of rotation (a), and the back tension R, which acts on the individual toothed rims 10 through the coiling sleeves 16, cause the pinions 8, which engage the toothed rims 10, to rotate in the clockwise direction (b), and the rotating pinions 8 deliver oil 15 from chamber 12*a* to chamber 12*b* of the hydraulic chamber 12, so that an oil pressure is built up in chamber 12*b*. The oil pressure in the chambers 12*b* causes a pressure K to be exerted on the individual toothed rims 10 through the tooth flanks 17 of the teeth 13.

At the end of the start-up phase, the individual strips 2 are recoiled by the core shaft 4, which rotates at a constant operating speed, into coils 3 on the individual coiling sleeves 16 of the recoiler 1 at a constant coil tension B. In the process, an equilibrium is established between the pressure K acting on the individual toothed rims 10 due to the oil pressure in chamber 12*b* and the back tension R, so that the toothed rims 10 rotate synchronously with the core shaft 4.

If the strip tension B and back tension R on one or more of the toothed rims 10 decreases due to a smaller strip thickness of one or more individual strips compared to the other individual strips, resulting in a smaller coil diameter of the corresponding coil or coils 3 compared to the other coils, this or these toothed rims 10 are temporarily caused to go into an advancing rotational motion in arrow direction (a) relative to the core shaft 4 as a result of the decreasing pressure K in chamber 12*b*, so that the pinion or pinions 8 turn counterclockwise, until the pressure K due to oil pressure in the adjacent space of chamber 12*b* is built up again and equalized.

Equilibrium is reestablished between the pressure K and the back tension R on the toothed rim or toothed rims 10, and a constant strip tension B on the corresponds strip coil or coils 3 is established. This process occurs continuously and infinitely variably during operation.

Depending on the strip tension B on the strip coils 3 of the individual strips 2, which varies according to differences in the thickness of the individual strips, different relative speeds of the toothed rims 10 of the recoiler can develop automatically.

The cooling oil is advantageously fed into the pressurized chamber 12*b* via the unpressurized chamber 12*a* by a pressure-controlled pump in the coolant circulation.

In a modified embodiment of the recoiler, the pinions can be pivoted on an additional shaft.

In addition, the clamping devices for the coiling sleeves 16 can be operated by the hydraulic oil in chamber 12*b* of the hydraulic chamber 12.

What is claimed is:

1. Recoiler for recoiling strip-shaped materials, especially for slitting and recoiling machines for the longitudinal slitting of thin rolled strip made of metal and steel into individual strips and the recoiling of the individual strips into strip coils, with a core shaft that can be driven by a motor, clamping devices for securing strip-coil coiling sleeves, which can be slid onto and pulled off of the recoiler, and structural components for transmitting the torque of the core shaft to the individual coiling sleeves during recoiling of the individual strips with equal or approximately equal strip tension, wherein a core shaft (4) with a truncation (6) that runs in the direction of the shaft axis (5—5), in which at least one cylindrical groove (7), which runs in the direction of the shaft axis (5—5), is formed as a bearing for a series of adjacent pinions (8) with external teeth (9); by toothed rims (10) pivoted on the core shaft (4), which have internal teeth (11), which engage the external teeth (9) of the pinions (8) that are assigned to the individual toothed rims (10); and by clamping devices arranged on the outer circumference of the toothed rims (10) for clamping the coiling sleeves (16), such that the sets of pinions (8) and toothed rims (10) are sealed liquid-tight from one another and from the two ends of the core shaft (4) in such a way that the core shaft (4) forms a closed hydraulic chamber (12) with the toothed rims (10), which is filled with hydraulic fluid (oil 15).

2. Recoiler in accordance with claim 1, wherein the fact that the pinions (8) are sealed from one another with a tight fit.

3. Recoiler in accordance with claim 1, wherein the fact that the coiling sleeves (16) can be clamped on one or more toothed rims (10) of the recoiler (1), depending on the width of the coil.

4. Recoiler in accordance with claim 1, wherein the fact that the hydraulic chamber (12) is divided by the pinions (8) into two chambers (12*a*, 12*b*).

5. Recoiler in accordance with claim 1, wherein the fact that the hydraulic chamber (12) can be connected to an oil source by channels in the core shaft (4) for filling the chamber with oil (15) and for supplying cooling oil.

6. Recoiler in accordance with claim 1, wherein operation of the clamping devices for the coiling sleeves is (16) by the hydraulic fluid in the hydraulic chamber 12.

7. Coiling sleeve in accordance with claim 1, wherein the fact that the pinions (8) are pivoted on an additional shaft.

* * * * *